US008556312B2

(12) United States Patent
Hellgren

(10) Patent No.: US 8,556,312 B2
(45) Date of Patent: Oct. 15, 2013

(54) CONTAINER-LIFTING SPREADER WITH DRIVE FOR THE TELESCOPIC MOVEMENT OF SPREADER'S BEAMS PROTECTED AGAINST DAMAGE BY COLLISION

(75) Inventor: Anders Hellgren, Jarfalla (SE)

(73) Assignee: Cargotec Sweden AB, Kista (SE)

( * ) Notice: Subject to any disclaimer, the term of this patent is extended or adjusted under 35 U.S.C. 154(b) by 0 days.

(21) Appl. No.: 13/580,554

(22) PCT Filed: Feb. 22, 2011
(Under 37 CFR 1.47)

(86) PCT No.: PCT/SE2011/050195
§ 371 (c)(1),
(2), (4) Date: Jan. 7, 2013

(87) PCT Pub. No.: WO2011/105956
PCT Pub. Date: Sep. 1, 2011

(65) Prior Publication Data

US 2013/0200640 A1 Aug. 8, 2013

(30) Foreign Application Priority Data

Feb. 24, 2010 (SE) ..... 1050175

(51) Int. Cl.
*B66C 1/66* (2006.01)

(52) U.S. Cl.
USPC ..... 294/81.53; 294/81.1

(58) Field of Classification Search
USPC ..... 294/81.53, 81.1, 81.2, 81.21, 907, 81.5, 294/81.51, 81.52, 81.4
See application file for complete search history.

(56) References Cited

U.S. PATENT DOCUMENTS

| | | | | |
|---|---|---|---|---|
| 1,763,351 | A | 6/1930 | Gfrorer | |
| 3,501,193 | A * | 3/1970 | Gray | 294/81.53 |
| 3,514,146 | A * | 5/1970 | Zweifel et al. | 294/81.21 |
| 3,677,599 | A * | 7/1972 | Shannon | 294/81.53 |

(Continued)

FOREIGN PATENT DOCUMENTS

| | | |
|---|---|---|
| DE | 2803935 | 8/1979 |
| DE | 10140449 | 3/2003 |
| EP | 1847504 A1 | 10/2007 |
| JP | 59-30076 U | 2/1984 |
| JP | 940352 A | 2/1997 |
| SE | 529521 | 9/2007 |
| WO | 0105696 A1 | 1/2001 |

OTHER PUBLICATIONS

Extended European Search Report, dated Jun. 6, 2013, from corresponding EP application.
International search report dated May 12, 2011 in corresponding PCT/SE2011050195.

*Primary Examiner* — Paul T Chin
(74) *Attorney, Agent, or Firm* — Young & Thompson

(57) ABSTRACT

A container-lifting spreader includes locking pins insertable into seats formed at the corners of a container and upon rotation about their longitudinal axes are brought in locked engagement therewith. The locking pins are in pairs associated with a common drive effecting simultaneous rotation of the pins between locking and unlocking positions. The drive includes a reversible motor and a power transmission that includes two push rods respectively, each of which is hinged at one end to a locking pin, and at the other end to an operating lever included in the power transmission, such that a driven movement of the lever is transferred via the push rods to rotational movements of the pins. The lever acts as a pivoting arm supported on a rotatable shaft, the arm cooperating with fixed stops that mechanically limit the movement of the lever within an angular space determined by the e distance between the stops.

10 Claims, 2 Drawing Sheets

(56) References Cited

Figure 1:
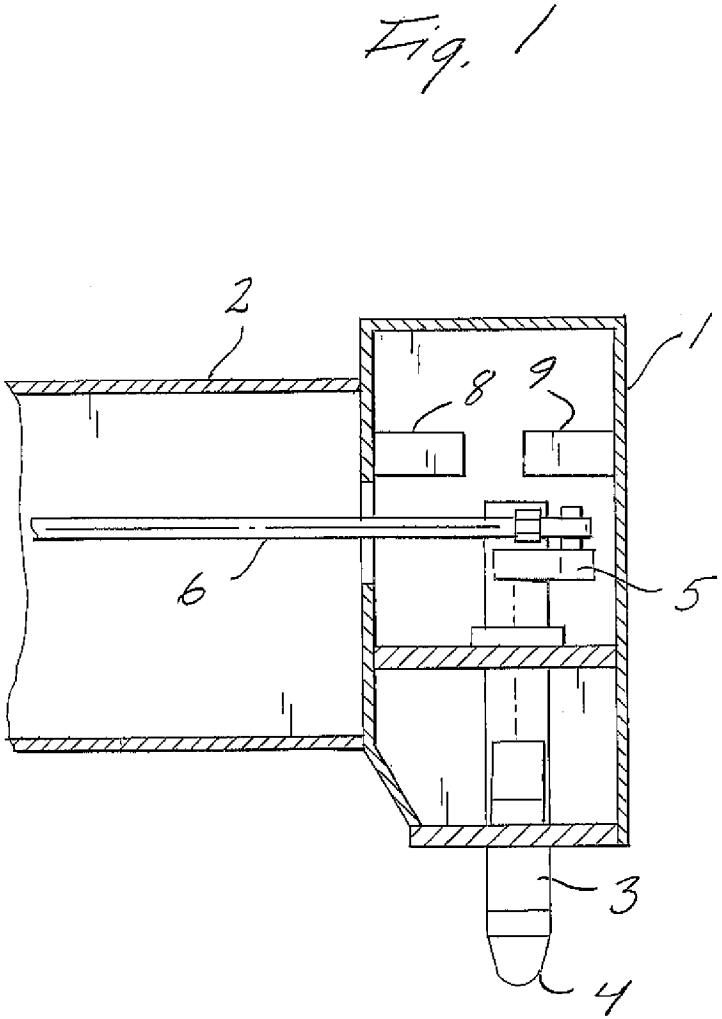

U.S. PATENT DOCUMENTS 3,751,096 A * 8/1973 Wyon ..... 294/81.53
3,799,601 A * 3/1974 Johansson et al. ..... 294/81.53
3,868,139 A * 2/1975 Drelicharz ..... 294/81.4
3,892,436 A * 7/1975 Fathauer ..... 294/81.53
4,444,426 A * 4/1984 Taylor ..... 294/81.53
4,630,856 A * 12/1986 Weem et al. ..... 294/81.53
7,128,353 B2 * 10/2006 Jussila et al. ..... 294/81.53

* cited by examiner

CONTAINER-LIFTING SPREADER WITH DRIVE FOR THE TELESCOPIC MOVEMENT OF SPREADER'S BEAMS PROTECTED AGAINST DAMAGE BY COLLISION

TECHNICAL FIELD OF THE INVENTION

The present invention refers to a container-lifting spreader comprising locking pins, in the subject technical field also named twist-locks, that reach downwards from the spreader at least in the ends of the spreader and which are insertable in seats formed in the upper corners of a container to be lifted by the spreader, the locking pins being rotatable about their longitudinal axes to provide a locking engagement with the container.

BACKGROUND AND PRIOR ART

Spreaders of this type are known from ports and terminals where they are used for transferring shipping containers from ships to road- or railroad vehicles, and vice versa. Typically, the spreader forms a part of an arrangement that further comprises cable sheaves by means of which the spreader is supported from a crane that operates and controls the moves of the spreader, and the spreader may be detachably coupled to the arrangement. Among the typical spreader movements are lowering of the spreader for coupling the spreader to one or several shipping containers, lifting and lowering of the spreader and container together, and horizontal shifting of spreader and container from one storage location to another. The invention is however not limited to spreaders supported in cables, but can also be applied to a spreader that is mounted in a lifting arm.

In order for connecting a container detachably to the spreader, the container comprises in each of its upper corners a seat shaped as an oblong hole that is open upwards. A head formed in a lower end of the locking pin can be inserted through the hole in an unlocking position of the locking pin. When inserted in the seat, rotation of the locking pin through about 90° into a locking position causes the head to engage from below the edge area about the oblong hole, this way connecting the spreader to the container. Unlocking is accomplished by turning the locking pin back to its original position.

Rotation of the locking pins between locking and unlocking positions is usually accomplished via push rods driven by means of hydraulic cylinders. The push rods are hingedly connected to the locking pins and arranged for simultaneous rotation of locking pins operated in pairs. The rotational position of the locking pins is typically controlled by means of sensors or limit switches that control the operation of the cylinder.

A sensor controlled operation of the rotational movements of the locking pins may however involve a risk of inaccurate positioning of the locking pins in the locking and unlocking positions. Deposits of dirt, wear, and play in mountings or interference with the sensors or control signals are factors that in course of time may cause displacement of the end positions in locking and unlocking modes of the locking pins, which in turn may lead to less secure connections between the spreader and the shipping container.

SUMMARY OF THE INVENTION

The present invention aims to avoid this security risk. To that purpose, the present invention provides an arrangement wherein the locking and unlocking positions of the locking pins are positively and mechanically fixed.

More precisely, the present invention discloses a container-lifting spreader comprising locking pins for insertion in seats arranged in corners of a shipping container. By rotation about their longitudinal axes the locking pins can be brought in locking engagement with the container. The locking pins are in pairs associated with a common drive to be simultaneously rotated between locking and unlocking positions. The drive comprises a reversible motor and a power transmission including a pair of push rods, each of which is in one end hinged to a locking pin and the other end of which is hinged to an operating lever such that a driven motion of the operating lever is converted via the push rods to a rotary motion in the locking pins. The operating lever comprises an arm supported from a rotatable shaft and associated with fixed stops that limit mechanically the movement of the operating lever within an angular space that is determined through the angular distance between the stops. The fixed stops this way provide an absolute definition of the locking and unlocking positions of the locking pins.

The fixed stops may be realized in different alternative ways in order to limit the rotary movement of the operating lever. In one embodiment, preferred due to its compact design, the stops are formed on the exterior of a gear housing that houses an angle gear included in the power transmission. More precisely, a preferred embodiment of the invention comprises a power transmission operatively engaged between the operating lever and the motor, said power transmission including an input shaft driven by the motor and having an external gear, and an output shaft driving the operating lever and likewise having an external gear, wherein the intermeshing gears of the input and output shafts together form an angle gear supported in a gear housing onto the exterior of which the fixed stops are arranged.

Advantageously, the fixed stops are shaped as a pair of abutting faces on a heel that projects from the gear housing, and against which the operating lever is alternatingly forced into contact in the locking and unlocking positions of the locking pins. The heel may be formed as an integral part of a gear housing that is produced by moulding.

In another preferred embodiment, the operating lever projects in opposite directions from the output shaft which reaches out from the gear housing. In this embodiment, two diametrically opposite heels each of which has two abutting faces is located one on each opposite side of the projecting shaft, wherein the operating lever is simultaneously forced into contact with one abutting face on each one of the heels. This embodiment spares the shaft and shaft journals in the gear housing since lateral forces applied to the shaft will be reacted in opposite directions.

In most embodiments it can be foreseen that the necessary rotation of the locking pins can be provided if the abutting faces is arranged to have an angular spacing in the order of 75-150°, or an angular spacing of at least 85-95°.

In the case where the motor is hydraulic, a pressure control operative for controlling the fluid flow to the motor via directional valves may be included in the hydraulic circuit as conventional. In the case of an electric motor, a current control may correspondingly be arranged in the motor's power supply circuit and operative for controlling the power supply to the motor by means of switches. For environmental reasons electric motors are preferred in connection with the invention.

The angular gear may in both cases be arranged as an irreversible angle gear, with a self-locking mesh of gears such that rotation of the input shaft results in rotation of the output shaft and the operating lever, whereas the opposite is prevented by the self-locking mesh of gears. This embodiment of the power transmission omits the need for an additional arresting of the locking pins in the locking position.

In order to protect the motor, a cut-off coupling may be arranged in the power transmission between the motor and the operating lever, the cut-off coupling arranged to release in result of an abnormal torsional moment being externally applied to the output shaft. This embodiment prevents damage on motor, power transmission and gear housing which might otherwise occur as the result of an incidental failure, such as a collision or as caused by incorrect handling.

The cut-off coupling may advantageously be arranged between the output shaft and a gear ring carried concentrically on the output shaft. In a preferred embodiment the cut-off coupling is arranged between the output shaft and a gear ring that is supported on the output shaft and forms part of the self-locking angle gear. In an alternative embodiment, the cut-off coupling may be arranged between the output shaft and the operating lever which is non-rotationally connected to the output shaft. The motor will in both cases be isolated from damage caused by a forced rotation of the locking pins. In the latter case also the angle gear is isolated from such damaging forces.

In one embodiment the cut-off coupling may comprise a shear-off pin or other breakable element which in non-broken condition holds the gear ring non-rotationally to the output shaft. Even more preferred, the cut-off coupling may be arranged in the form of a sliding clutch which holds the gear ring non-rotationally to the output shaft by friction during normal operations up to a predetermined torsional moment. In this preferred embodiment, the cut-off coupling may advantageously include a conical ring arranged to slide on the output shaft, and which can be pressed against a conical inner periphery of the gear ring by a controllable force.

SHORT DESCRIPTION OF THE DRAWINGS

Figure 2:
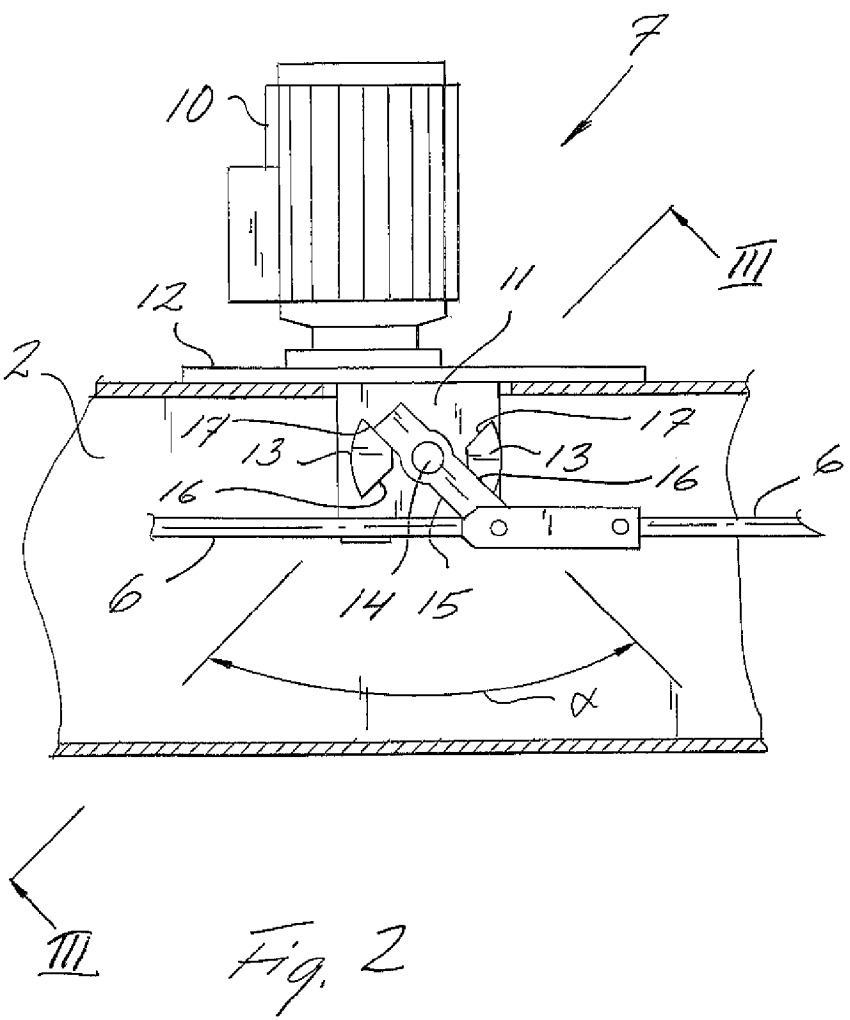
Figure 3:
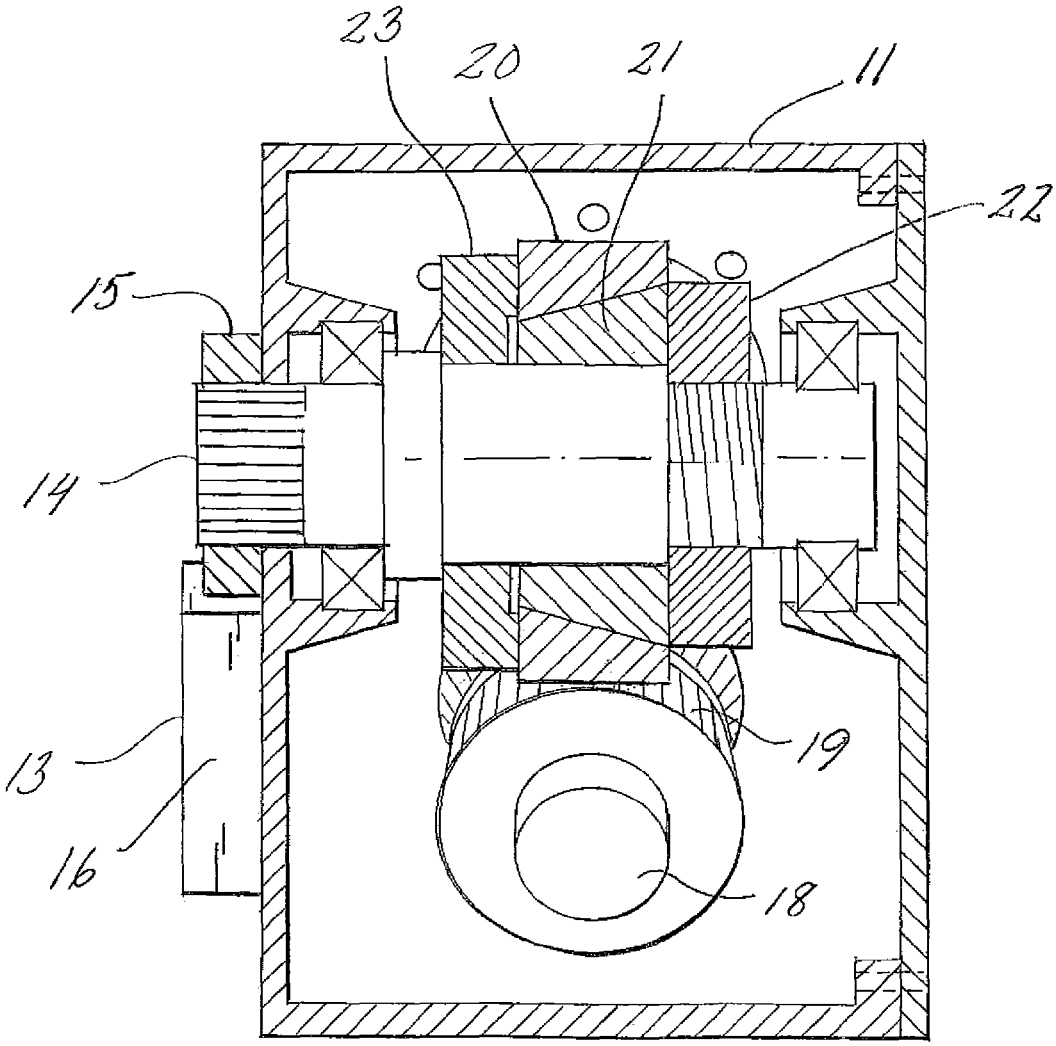

The invention will be more closely explained below with reference made to an example thereof described in detail, and by reference to the accompanying schematic drawings. In the drawings, FIG. 1 shows the arrangement of a locking pin in a partially broken away portion of the connection between a transverse spar and a longitudinal beam in a container-lifting spreader;

FIG. 2 shows a drive unit for rotation of the locking pins between locking and un-locking positions, in a broken away portion of the transverse spar of FIG. 1, and FIG. 3 is a sectional view through the drive unit of FIG. 2.

DETAILED DESCRIPTION OF A PREFERRED EMBODIMENT EXAMPLE

The general structure and function of container-lifting spreaders is notoriously known to persons skilled in the art and needs no closer explanation. The same applies to the locking pin in question, which for the purpose of the present invention may be conventional and may include conventional and known features.

The partially broken away view of FIG. 1 illustrates an outer end of a longitudinal beam 1 forming part of a container-lifting spreader. A transverse spar 2 connects to the longitudinal beam 1 at right angles. A locking pin 3 is journalled in the end of the longitudinal beam to be rotatable between locking and unlocking positions which typically are separated at an angular distance of 90°. A head 4 in an end of the locking pin is formed for engagement with a corner fitting or seat of a container as is known per se. An arm 5 extends in a radial direction from the locking pin, a push rod 6 being hinged to the arm. Rotational movement of the locking pin is transferred from a drive unit 7, illustrated in FIGS. 2 and 3, via the push rod 6. Reference numerals 8 and 9 refer to position indicators, the primary function of which is to confirm to the operator of the spreader the position of the locking pin.

In a broken away portion of the longitudinal beam 2, seen in the view direction of FIG. 1 and thus in the longitudinal direction of the spreader, FIG. 2 illustrates the drive unit for rotation of the locking pins. The drive unit comprises a motor 10 having an output shaft reaching into a gear housing 11. The motor and the gear housing are assembled on a mounting plate 12 by which the drive unit can be mounted on the transverse spar such that the gear housing is inserted through an opening formed in the upper web of the transverse spar. Two heels 13 are formed on the exterior of the gear housing, the heels projecting from the surface of the gear housing. The heels 13 are located at diametrically opposite positions, one on each opposite side of an output shaft 14 exiting the gear housing. An operating lever 15 is non-rotationally supported on the output shaft, such as by means of a splines connection. The operating lever 15 is formed as an operator arm 15, an outer free end of which is hinged to the push rods 6 that extend in the longitudinal direction of the transverse spar to the locking pins at the corners of the spreader.

The heels 13 are shaped as sectors of a circle and provide abutting faces 16 and 17 that run substantially tangential to the shaft 14. The abutting faces provide in cooperation two mechanical stops that limit the motion of the operating lever 15 within an angular space that is determined by the angular distance between the abutting faces. The heels 13 thus limit the length of possible movement of the push rods in the length direction of the transverse spar, and provide an absolute determination of the locking pin's locking and unlocking positions/rotational positions.

It will be understood that the invention may be realized with two abutting faces 16-16 or 17-17, each of which singularly stops the operating lever in either of its two end positions respectively. It will also be seen that abutting faces cooperating in pairs provide an advantageous distribution of forces in connection with an operating lever 15 that extends on both sides of the output shaft 14, as in the illustrated and preferred embodiment.

Bearing the aforesaid in mind, it is merely a designer's task to determine the required length and angular movement of the operating lever with respect to the desired stroke length of the push rods 6. It can be foreseen that for most applications it will be sufficient and suitable to form an intermediate angle $\alpha$ between opposite abutting faces 16-16 or 17-17 at the order of 75-150°, or at least at the order of 85-95°.

The drive unit preferably includes an electric induction motor 10 with reversible rotation. In order to protect the motor from overloading as the operating lever 15 is stopped against the heels 13, the motor's current consumption can be monitored and the current supply to the motor can be controlled and cut in response to a detected peak in the current consumption, in conventional ways.

In order to protect the motor from mechanical overload and forces transmitted to the motor via locking pins and push rods, the drive unit preferably comprises a self-locking angle gear included in the power transmission between the motor 10 and the output shaft 14.

Reference is now made to FIG. 3 wherein the power transmission is shown in a sectional view through the gear housing 11 along the section line III-III of FIG. 2. A gear ring 19 is arranged on the input shaft 18 entering from the motor. The teeth of gear ring 19 engage the teeth of a gear ring 20 arranged on the output shaft 14 that exits from gear housing 11, the shaft 14 journalled at an angle to the input shaft 18. In other words, the shafts 18 and 14 and associated gear rings 19 and 20 respectively form an angle gear. The pitch of threads of the gear rings 19 and 20 is chosen to provide a self-locking mesh of gears, such that rotation of the input shaft 18 causes rotation of the output shaft 14, whereas the opposite is prevented by the self-locking mesh of gears.

In result of the aforementioned structure of the power transmission the same is operative for holding the locking pins in their set positions which can be altered solely by operating the motor, whereas external force acting on the locking pins is blocked in the self-locking angle gear.

It will be foreseen that a powerful collision between a locking pin and any object from the surroundings can be transferred to the output shaft 14, via a push rod and the operating lever, resulting in a torsional moment which can cause damage to the components of the angle gear.

In order to avoid this risk the present invention further teaches that a cut-off coupling is arranged in the power transmission between the motor and the operating lever. The cut-off coupling is configured to release in result of an abnormal torsional moment being externally applied to the output shaft 14.

In the illustrated embodiment, the cut-off coupling is realized as a sliding clutch that holds the gear ring 20 non-rotationally to the output shaft during normal operating conditions. More precisely, the cut-off coupling is realized in the preferred embodiment in the form of a conical ring 21 that is inserted between the shaft 14 and the gear ring 20. The conical ring 21 has a conical outer periphery which can be pressed to engage by friction a conical inner periphery of the gear ring 20. The conical ring 21 may be non-rotationally supported on the shaft 14 by means of a corresponding frictional engagement, or in other way such as by means of a key and key groove, or through a splines connection or similar. A rotatable locking ring 22 in threaded engagement with the shaft 14 is effective for adjustably pressing the conical ring 21 against the gear ring 20, in cooperation with a ring 23 fixed to the shaft and effective as counter support for the gear ring 20 when tightening the conical ring 21.

ADVANTAGES AND FEASIBLE MODIFICATIONS OF THE INVENTION

It can be foreseen that the self-locking angle gear avoids the need for an additional locking function in order to arrest the locking pins in their set rotational positions. However, the invention does not expel the use of separate arrest means in association with the locking pins.

It will also be foreseen that the cut-off coupling serves as a frictional clutch that spares the power transmission and motor in the event of an abnormal torsional moment being externally applied to the output shaft of the angle gear.

As an alternative to the preferred frictional clutch, a cut-off coupling between the output shaft and gear ring supported thereon can be realized by means of replaceable break-off elements having a resistance to rupture that is below the tensile strength and ability to resist deformation in the gear rings.

It will further be foreseen, without being specifically illustrated in the drawings, that the cut-off coupling can be arranged externally of the gear housing such as between the output shaft and the operating lever supported on the output shaft.

The invention is defined in the accompanying claims set wherein subordinated claims recite alternative and advantageous embodiments of the solution recited in the independent claim.

The invention claimed is:

1. A container-lifting spreader comprising locking pins (3,4) that are insertable into seats formed at the corners of a shipping container and upon rotation about their longitudinal axes can be brought in locked engagement with the container, wherein the locking pins are in pairs associated with a common drive (7) effecting simultaneous rotation of the locking pins between locking and unlocking positions, the drive comprising a reversible electric motor (10) and a power transmission that comprises two push rods (6), each of which is in one end hinged to a locking pin (3,4) and in the other end hinged to an operating lever (15) included in the power transmission, and in such way that a driven movement of the operating lever is transferred via the push rods to rotational movements of the locking pins, and further wherein the power transmission comprises an input shaft (18) driven by the motor and having an external thread (19), as well as an output shaft (14) supporting the operating lever and likewise having an external gear ring (20), the said shafts in threaded engagement forming an angle gear, the angle gear providing a self-locking mesh of threads such that rotation of the input shaft (18) causes rotation of the output shaft (14) and the operating lever (15), whereas the opposite is prevented by the self-locking mesh of gears, characterized in that fixed stops (16; 17) are arranged to mechanically limit the movement of the operating lever (15) within an angular space ($\alpha$), the fixed stops this way providing in cooperation with the self-locking angle gear absolute positioning of the locking pins in locking and unlocking rotational positions.

2. The spreader according to claim 1, characterized in that the fixed stops (16; 17) are formed as abutting faces on a heel (13) that projects from a gear housing (11), and against which the operating lever (15) is brought in contact in the locking and unlocking positions of the locking pins.

3. The spreader according to claim 2, characterized in that the operating lever (15) extends on opposite sides of the output shaft (14) that projects form the gear housing, and two heels (13), each having two abutting faces (16; 17), are located one on each opposite side of the output shaft (14) whereby the operating lever (15) simultaneously contacts one respective abutting face on each of said two heels.

4. The spreader according to claim 3, characterized in that the abutting faces (16, 16; 17, 17) are arranged at an intermediate angular distance in the order of 75-150°, and at an angular distance of 85-95° at least.

5. The spreader according to claim 4, characterized in that a sliding clutch is incorporated in the self-locking angle gear to act between the output shaft (14) and the gear ring (20) supported on the shaft.

6. The spreader according to claim 2, characterized in that a sliding clutch is incorporated in the self-locking angle gear to act between the output shaft (14) and the gear ring (20) supported on the shaft.

7. The spreader according to claim 3, characterized in that a sliding clutch is incorporated in the self-locking angle gear to act between the output shaft (14) and the gear ring (20) supported on the shaft.

8. The spreader according to claim 1, characterized in that a sliding clutch is incorporated in the self-locking angle gear to act between the output shaft (14) and the gear ring (20) supported on the shaft.

9. The spreader according to claim 8, characterized in that the sliding clutch holds the gear ring (20) non-rotationally to the output shaft (14) by friction.

10. The spreader according to claim 9, characterized in that the sliding clutch comprises a conical ring (21) slidably supported on the output shaft (14) and arranged to be adjustably pressed against a conical inner periphery of the gear ring (20).

* * * * *